United States Patent [19]

Goessler

[11] Patent Number: 4,931,621

[45] Date of Patent: Jun. 5, 1990

[54] ELECTRIC HEATER

[75] Inventor: Gerhard Goessler, Oberderdingen, Fed. Rep. of Germany

[73] Assignee: E.G.O. Elektro-Gerate Blanc u. Fischer, Fed. Rep. of Germany

[21] Appl. No.: 231,132

[22] Filed: Aug. 11, 1988

[30] Foreign Application Priority Data

Aug. 18, 1987 [DE] Fed. Rep. of Germany ... 8711209[U]

[51] Int. Cl.[5] ..... H05B 3/74

[52] U.S. Cl. ..... 219/467; 219/466

[58] Field of Search ..... 219/466, 467, 468, 458, 219/459, 460, 461, 464

[56] References Cited

U.S. PATENT DOCUMENTS

| | | | |
|---|---|---|---|
| 1,348,648 | 8/1920 | Kelly | 219/466 |
| 2,494,447 | 1/1950 | Mosthaf | 219/451 |
| 3,500,018 | 3/1970 | Stiller | 219/443 |
| 4,511,789 | 4/1985 | Goessler | 219/449 |
| 4,538,051 | 8/1985 | Schreder | 219/449 |
| 4,713,527 | 12/1987 | Kicherer | 219/457 |

FOREIGN PATENT DOCUMENTS

| | | | |
|---|---|---|---|
| 114307 | 8/1984 | European Pat. Off. . | |
| 163106 | 12/1985 | European Pat. Off. . | |
| 208823 | 1/1987 | European Pat. Off. . | |
| 3315438 | 10/1984 | Fed. Rep. of Germany . | |
| 3545443 | 6/1987 | Fed. Rep. of Germany | 219/445 |
| 2539940 | 7/1984 | France . | |
| 193572 | 2/1938 | Switzerland . | |
| 2186166 | 8/1876 | United Kingdom . | |
| 447565 | 5/1936 | United Kingdom | 219/457 |

*Primary Examiner*—Teresa J. Walberg

*Attorney, Agent, or Firm*—Steele, Gould & Fried

[57] ABSTRACT

In the case of an electric heater, particularly a radiant heater for glass ceramic hotplates, there are several spirally nested heating resistors, whereof one heating resistor continuously passes through in the central field in such a way that it forms two nested spirals (10, 17) distributed approximately uniformly over the entire heating field, but which are not directly adjacent to one another and instead between their spiral turns (20, 21) is provided at least one spiral turn of a further, spirally wired heating resistor. This makes it possible in simple manner to make the length of said first-mentioned heating resistor much larger, so that it has a very high rated power, but can still be safely laid or wired in the heating field without any risk of local overheating.

29 Claims, 1 Drawing Sheet

ELECTRIC HEATER

BACKGROUND OF THE INVENTION

1. Field of the Invention

Figure 1:
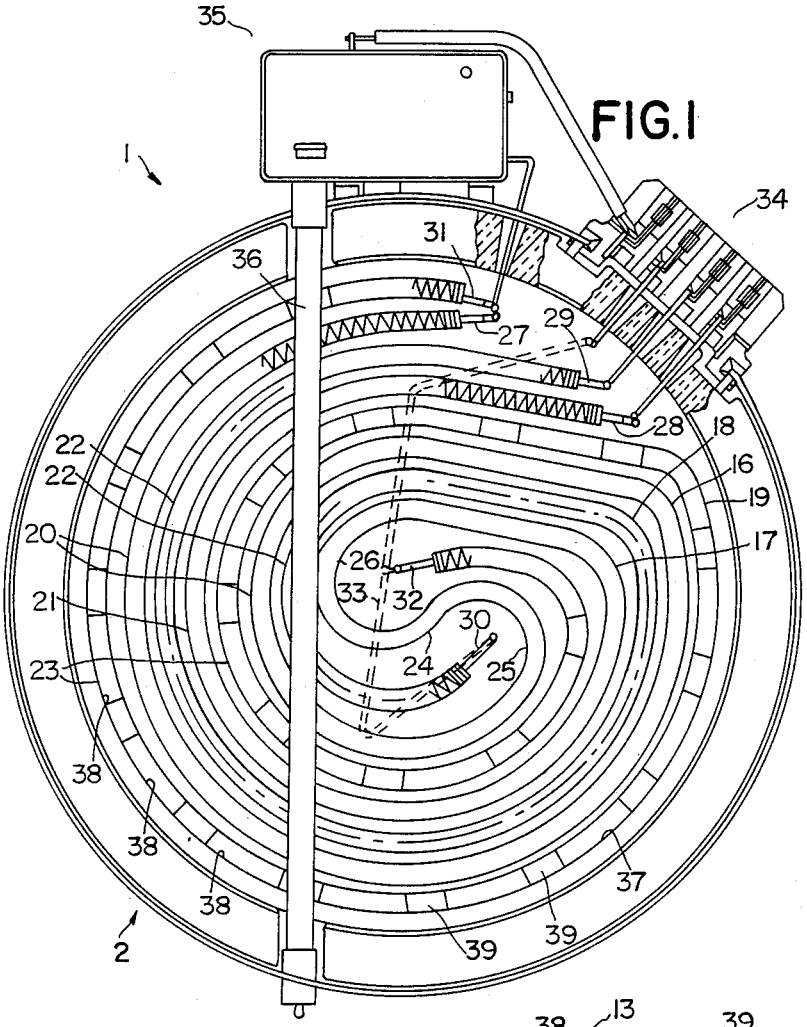

The invention relates to an electric heater with at least one spirally arranged heating resistor, and in particular to an improved arrangement wherein a plurality of heating resistors are disposed uniformly on a cooking surface and are switchable in power steps.

Heaters with spirally arranged heating resistors as known, for example, from U.S. Pat. No. 4,538,051—Schreder et al, are mainly used as radiant heaters for the cooking points of cookers. The cooking surface defined by the complete heating field of the heater is heated in different cooking fields during each operational switching position. For example, the resistors are powered at each power setting of the heater as a whole, and not individually, as would also be possible. The heater can also be provided for heating a baking oven muffle, a cast metal hotplate body of an electric hotplate, or some other wall to be heated. In the case of construction as a radiant heater and not as conductive a heater, whose heating resistors are completely embedded in a pressed insulating material, the heater is appropriately arranged on the back of a transparent plate, e.g. a glass ceramic plate. The standard arrangement of the heating resistors is such that using a so-called seven step timing switch, it is possible selectively to switch three heating resistors between a minimum and a maximum total power through a randomly selected individual, series and/or parallel connection of the resistors defining six power stages, the seventh stage being used for the complete disconnection of all the heating resistors. In general, the heating resistors have different rated power levels, so that a heating resistor to be operated just below the average total power, e.g. in the fourth power stage in individual connection has the highest rated power. A heating resistor to be operated in a power stage below it, e.g. the third stage in individual connection has an average rated power, and the third heating resistor has the lowest rated power. If the three heating resistors are only arranged in two spirals, i.e. in a double thread, then for specific power settings in which one or more heating resistors are completely disconnected, there can be a relatively non-uniform spatial distribution of the heating in such a way that heating power is only obtained in the peripheral area or only in the central area of the overall heating field, which although desirable in certain cases, is not appropriate in others.

2. Summary of the Invention

An object of the present invention is to provide a heater of the aforementioned type in which, in simple manner, it is possible to make the length of at least one first heating resistor greater than would be possible by laying or wiring in a single spiral, so that as a result of said length this heating resistor can have a relatively high rated power, but still ensures a problem-free laying or wiring in the heating field.

According to the invention this object is achieved in the case of an electric heater of the aforementioned type in that at least one heating resistor forms at least two spirals with nested spiral turns. In addition thereto or instead thereof one of these spirals formed by said first heating resistor can be extended over and beyond the spiral shape at the periphery and/or in the center of the heating field. A particularly advantageous arrangement is obtained if the first heating resistor forms an outer spiral and an inner spiral, the outermost turn of the outer spiral externally surrounding all the remaining spiral turns of said first heating resistor. It would also be conceivable for the first heating resistor to form three or more, and in particular also nested spirals, so that the heating resistor length would be increased and it would also be possible to further improve its uniform distribution of heat over the entire heating field. If the heating resistor comprises a wire coil, then despite the high rated power the wire cross-section can be made relatively small and it is possible to provide a relatively large coil pitch, which is advantageous with respect to the life of the heating resistor.

It is also possible to place two or more heating resistors in two or more spirals. However, generally the heating resistors are not then all arranged continuously in a common plane over their entire length and instead between adjacent portions or spirals of the heating resistor are provided electrically conductive connecting bridges, which are displaced towards the back or front of said heating resistor with respect to said portions and in contact-free manner pass around the remaining heating resistor or resistors. A particularly advantageous construction is obtained if only a single heating resistor, particularly that with the highest rated power, is lengthened in the described way, because then between its two ends provided for the electrical connection it can be uninterruptedly continuous and identically constructed over its entire length and between its ends forms a length portion, which connects a spiral to the following, in particular also spiral portion.

In place of the described construction, but in particular in addition thereto, the invention also provides with respect to a heating resistor the embedding in an insulating body of spaced longitudinal portions and interposed longitudinal portions substantially in exposed manner and in particular in portions of a spiral slot. Appropriately the insulating support is provided with rib-like or stud-like protuberances shaped therefrom and running in spaced manner in the longitudinal direction of the heating resistor. The heating resistor or the heating coil is embedded over part of the helical circumference in the protuberance, whereby the particular heating resistor can be roughly half embedded in the vicinity of the protuberances and the area of the central axis of the heating coil is substantially free from embedding in such a way that the inner circumference of the heating coil does not have to be completely covered by the insulating body material in the vicinity of the embedding and can instead directly emit heat.

In a particularly advantageous manner the protuberances can be formed in that between adjacent protuberances in the longitudinal direction of the heating resistor is formed in each case one portion of the spiral slot, so that the protuberances do not have to project beyond the front or the front surface of the insulating body and instead said front surface together with the heat surfaces of the protuberances are located substantially in one plane. In order that at least partly exposed longitudinal portions of the heating resistor can be provided, said front surface is then hollowed out by corresponding depressions in the vicinity of said longitudinal portions, said depressions forming the portions of the spiral slot. However, the construction can also be in accordance with German patent 27 29 929, in which the protuberances receiving the heating resistors project beyond the front of the insulating body and reference should be made thereto for further details and effects.

These and further features of preferred further developments of the invention can be gathered from the claims, the description and drawings, whereby the individual features can be realized in an embodiment of the invention and in other fields either individually or in the form of subcombinations and can represent advantageous and optionally independently patentable constructions, for which protection is hereby claimed.

An embodiment of the invention is described in greater detail hereinafter relative to the drawings, wherein are shown:

FIG. 1 An inventive heater in a view of the front.

Figure 2:
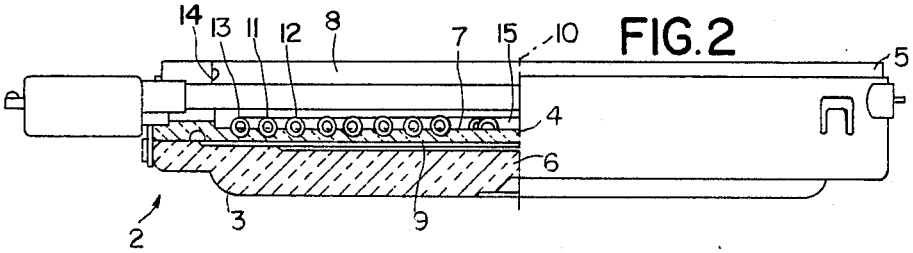

FIG. 2 A part section through the heater according to FIG. 1.

Figure 3:
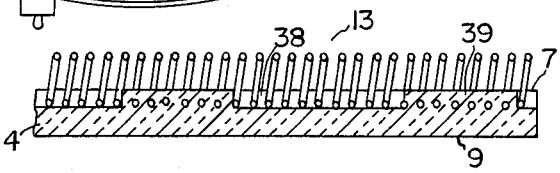

FIG. 3 A detail from FIG. 2 in a developed section.

The inventive heater according to FIG. 1 has a multipart carrier 2 open in shell-like manner towards the front. Carrier 2 essentially comprises a supporting shell 3 made from sheet metal or some similar, thin-walled material, in which is arranged a plate or card-like insulating body 4, supported with respect to its base, and which is pressed from an insulating material containing fibrous materials and has a cardboard-like structure. The insulating body 4 is centered with respect to the edge or casing of the supporting shell 3, and extending over most of the basic surface of said shell 3 has an edge 5 extending over its front and which is thicker than the shell. The insulating body 4 can be constructed in one place with the insulating body or as a separate component in the form of a ring and then appropriately engages over the insulating body 4 with a ring shoulder on the front. Edge or border 5 projects slightly beyond the edge of the supporting shell 3 and forms a planar, slightly elastic, resilient end face corresponding to the insulating material with which the heater 1 forming a closed subassembly is resiliently pressed in sealed manner against the back of a plate, e.g. a glass ceramic plate, such that an elastic, self-adjusting engagement is always ensured and the interior of the shell is sealed with respect to the outside. Insulating body 4 and border 5 are arranged on an at least one-layer insulating filling 6, which engages on the interior of the shell base of the supporting shell 3 and unlike the self-supporting insulating body 4 is made from a material with a relatively low mechanical strength, but high thermal insulating effectiveness, e.g. from a bulk material.

The front 7 of heater 1 is formed by end face of the insulator 4 exposed in the shell interior, and determines the heating field 8 of heater 1 with its surface extension bounded by the inner circumference of border 5. Back 9 of insulator 4 can only be supported in the marginal area on insulating filling 6 and otherwise has a gap spacing with respect thereto. Generally the heating field 8 has a symmetrical, e.g. circular, oval, rectangular or square shape with respect to its central axis 10, but it can also have other basic shapes. To the front 7 of insulator 4 are fixed three heating resistors 11, 12, 13 located in a common plane at right angles to central axis 10, the individual heating resistor being defined in that it is switched either on or off as a whole in the particular power stage. The individual heating resistor can be formed from separate, serial heating resistor portions or a continuous heating resistor located between its ends. The three heating resistors are formed by wire coils of different length and different wire cross-section, but with roughly the same spacing between the wires of each turn. Heating resistor 11 has the greatest length and the largest wire cross-section, heating resistor 12 the smallest length and the smallest wire cross-section and heating resistor 13 has an intermediate length and wire cross-section.

Heating resistors 11, 12, 13 are laid between the periphery 14 of heating field 8 and its center 15 formed by the inner circumference of border 5 in spirals 16, 17, 18, whereof the spiral configuration substantially corresponds to the basic shape of the heating field 8, but in the case of a circular basic shape is correspondingly rounded over an arc angle of approximately 300°, whereas over the remaining arc angle enclosing a connecting piece for the heating resistors are approximately linear and parallel to one another. The number of spirals is greater than the number of heating resistors and the number of spiral turns is greater than the number of spirals.

All the spiral turns are reciprocally parallel or with constant portions over substantially their entire length, all the spacings between adjacent spiral turns being substantially the same or smaller than their cross-sectional width, so that there is a very dense occupancy of the heating field with the heating resistors. Although it would be conceivable to arrange the spirals or spiral turns of at least one heating resistor immediately adjacent to one another, it is particularly advantageous if all the spirals are alternately juxtaposed in such a way that all the existing spirals follow one another.

The longest heating resistor 11 forms two nested spirals, namely an outer spiral 16 and an inner spiral 17, the outer spiral 16 taking up only slightly less than or approximately two full spiral turns 20, between which are located the same number of spiral turns of other spirals as there are heating resistors. However, the inner spiral 17 has a somewhat smaller number of spiral turns, namely only two turns and with its inner end, like the outer spiral 16, extends approximately into the center 15 of heating field 8. In the vicinity of said center the innermost turns 20, 21 of said two spirals 16, 17 are interconnected via a central, substantially S-shaped longitudinal portion 24 of said heating resistor 11. One approximately semicircular S-bow 25 is connected directly to the curved inner end of the inner spiral turn 20 of the outer spiral 16 and the other, more than semicircular S-bow 26 is directly tangentially connected to the inner, linear end of the spiral turn 21 of the inner spiral 17 in such a way as to surround the central axis 10.

Between the spirals 16, 17 of heating resistor 11 is located the spiral 18 of heating resistor 12, which substantially has the same number of spiral turns 22 as spiral 16 and whose inner end is approximately located in the center of the S-bow 25. Along the outside of spiral 16 of heating resistor 11 and therefore after approximately one outermost spiral turn 23 between said spirals 16, 17 and never directly adjacent to spiral 18, is located spiral 19 of heating resistor 13, which has a number of spiral turns 23 corresponding to spiral 16, namely approximately two spiral turns 23. The inner end of spiral 19 is substantially located in the center of the S-bow 26, so that the two said inner ends are provided on either side of longitudinal portion 24. The outer or outermost spiral turn 23 of spiral 19 extends approximately to the periphery 14 of heating field 8, while the outermost spiral turn 20 of heating resistor 11 is inwardly displaced by at least one spiral turn of the complete spiral arrangement. However, in the center 15 of heating field 8 is substantially located portions of all three heating resistors 11, 12, 13 in an approximately uniform distribution, so that there is no need for an unheated central zone.

The ends of the heating resistors 11, 12, 13 intended for electrical connection are in each case formed by a short portion with outer helical turns, into whose inner circumference, facing front 7, is in each case fixed a bow-shaped connecting wire which, adjacent to the helical end, is so sunk in the insulating body 4 with a U-shaped bow portion that the free bow leg projects from the inside of insulating body 4 in the direction of its front 7, the ends of said free bow leg being intended for electrical connection by means of welding or soldering.

Both ends 27, 28 of spirals 16, 17 of heating resistor 11 in the vicinity of the periphery 14 of heating field 8 are located on the outside of the overall spiral arrangement where, of the remaining heating resistors 12, 13, only one end 29 or 31 is located in this area. These outer connecting ends are substantially located in the arc angle enclosed by connecting piece 34, which e.g. comprises an insulating material basic body, which is fixed to the shell edge of supporting shell 3 in such a way that it essentially only projects beyond its outer circumference and is located between the planes of the end face of border 5 and the bottom of the supporting shell 3. Connecting piece 34 is provided with connecting members, e.g. with attaching plugs for leads, which connect the heater 1 with a manually operable switching means, e.g. a seven step timing switch.

From the connecting members rod-like connecting wires are led through border 5 immediately adjacent to the front 7 of insulating body 4 into the shell interior. On the outer circumference of the edge of supporting shell 3 and adjacent to the connecting piece 34 is fixed the switch casing of a thermal cutout 35 by means of which at least one, and appropriately less than all the heating resistors are switched. In the represented embodiment the outer, immediately adjacent ends 27, 31 of heating resistors 11, 13 are directly electrically conductively interconnected and, accompanied by the interposing of a thermal cutout 35, are jointly connected to an associated common connecting member of connecting piece 34, while the other end 28 of heating resistor 11 and the outer end 29 of heating resistor 12 are separately connected to two further connecting members. The inner ends 30, 32 of heating resistors 12, 13 are directly electrically interconnected by a bridge 33, which in contact-free manner engages around the central longitudinal portion 24 on the side remote from border 5 and can e.g. be located on the back 9 between insulator 4 and insulating filling 6. These inner ends 30, 32 are jointly connected by means of a connecting wire to a further connecting member of connecting piece 34, said connecting wire passing around the heating resistors or spirals in contact-free manner on the side remote from border 5 and can e.g. be located on the back 9 of insulating body 4 in the same way as bridge 33.

Heating resistors 11, 12, 13 are appropriately switched or connected in such a way that in the first, lowest switching stage all the heating resistors are connected in series; in the second stage only two heating resistors, namely 11 and 13 are connected in series; in the third and fourth switching stages heating resistors 13 and 11 are individually connected in, respectively. In the fifth switching stage the two heating resistors of the second switching stage are connected in parallel; and finally, in the sixth switching stage all the heating resistors are connected in parallel. The heating resistor 11 is consequently in operation in all the switching stages but one, which also applies with respect to heating resistor 13, whereas heating resistor 12 is only in operation in the lowest and highest switching stages.

The described construction ensures that in each switching stage there is a power density uniformly distributed over the heating field and also the heating resistors which are brightly illuminated in operation as a result of their wire cross-section or their power loading provide in each switching stage a direct display which is substantially uniform over the entire heating field in connection with the operating state of heater 1, so that through the glow pattern clearly visible through the glass ceramic plate or the like, it is easily possible to recognize with only a slight time delay the switched state of the heater.

Thermal cutout 35 has a linear, rod-like temperature sensor 36 fixed rigidly by its outer tube to the switch casing and is appropriately constructed as an expansion rod sensor. The sensor passes through border 5 in bore or slot-like openings on two facing sides and traverses the heating field 8 at a distance from the front 7 or with a small constant spacing from the heating resistors 11, 12, so that at a smaller distance from the central axis 10 than from the periphery 14 it is located on the side remote from ends 27, 28, 29, 31 of heating resistors 11, 12, 13 of the axial plane of carrier 2 parallel thereto. Through the thermal cutout 35, which at a maximum disconnects two or three heating resistors, if it responds, in the highest switching stage there is still partial power through further operation of heating resistor 12.

The heating resistors are fixed in the front 7 of insulating body 4 solely by embedding, namely by pressing them into insulating body 4 and/or by forcing the body in over part of the circumference thereof which is smaller than half the total circumference. At least one heating resistor, and in particular heating resistor 11, is embedded over its entire length, i.e. with each turn continuously identically deeply embedded, whereby the embedding between adjacent coils of the heating resistor can be such that the inner circumference of said coils is at least partly free towards the front and not, as would be conceivable, completely covered by insulating material.

In the case of at least one heating resistor, particularly the two heating resistors 12 and 13, the fixing by embedding in the described manner only takes place on longitudinal portions of the heating resistor which are spaced from one another, so that longitudinal portions located between said embedded longitudinal portions are substantially completely free at least with regards to the coil inner circumference and with said partial circumference of the outer circumference thereof engage on or in the insulating body 4. The exposed longitudinal portions are appropriately longer than the embedded longitudinal portions. So that it is possible that the exposed longitudinal portions, in the spiral longitudinal direction, are provided successive spiral slot portions 38 in the front 7 of insulating body 4, said portions 38 forming a substantially regularly interrupted spiral slot over the entire length thereof and being adapted in cross-section to the associated partial circumference of heating resistor 12 or 13. So as not to overburden the drawing, these spiral slot portions 38 are only shown in FIG. 1 for the spiral slot 37 receiving the heating resistor 13.

Compared with their slot base, the interruptions of the spiral slot 37 form protuberances 39, which can project above the base by more or less than the slot depth, but their height is appropriately precisely the same as the slot depth, so that their head faces are located flush in the plane of the front 7 of insulating body 4. In place of a continuous, planar front 7 of insulating body 4 between the spiral turns and in the vicinity of the protuberances 39, it is also conceivable to provide depressions or groove-like depressions between adjacent spiral turns in such a way that the particular heating resistor is located on either side in the manner of dam-like slopes between upwardly sloping sides of the insulating body, said sides defining the partial circumference with which the heating resistor engages in the insulating body. This makes it possible to better compress the insulating material of insulating body 4 immediately adjacent to the heating resistors.

The invention having been disclosed, variations on the inventive concept will occur to persons skilled in the art. Reference should be made to the appended claims rather than the foregoing specification in order to assess the scope of exclusive rights claimed.

I claim:

1. An electric heater, comprising:

a carrier having a front;

a number of elongated heating resistors, including a first heating resistor and at least one non-first additional heating resistor, arranged in spirals defining nested spiral turns on said front of the carrier, said heating resistors being switchable in a higher number of power stages than corresponds to their number, at least one said first heating resistor being defined by a spiral strand only entirely operable; and, a heating field defined by said heating resistors, wherein said at least one first heating resistor forms at least a double spiral with at least two spirals operable only commonly, a first spiral of said at least two spirals forming at least one first spiral turn and a second spiral of said at least two spirals forming at least one second spiral turn, at least two said first and second spiral turns of said first heating resistor being located laterally adjacent to one another, at least one spiral turn of at least one said non-first additional heating resistor engaging between said first and second spiral turns.

2. The heater according to claim 1, wherein alternately interengaging adjacent first and second spiral turns of spirals of said at least one first heating resistor are alternately located between the spiral turns of at least one said non-first additional heating resistor.

3. The heater according to claim 1, wherein between two spirally meshing first and second spiral turns of said at least two first and second spirals of said at least one first heating resistor is located at least one spiral turn of at least one said non-first additional heating resistor.

4. The heater according to claim 1, wherein between alternately adjacent and substantially spirally parallel first and second spiral turns of the first heating resistor are alternately provided spiral turns of at least two of said non-first additional heating resistors.

5. The heater according to claim 1, wherein said at least one first heating resistor forms a single first and a single second spiral, at least one of said first and second spirals extending substantially into a center and substantially up to a periphery of said heating field.

6. The heater according to claim 1, wherein at least one said non-first additional heating resistor is constructed as a single spiral.

7. The heater according to claim 1, wherein innermost first and second spiral turns of said at least one first heating resistor are located in the vicinity of a center of said heating field and are electrically conductively interconnected on the front of said carrier.

8. The heater according to claim 1, wherein innermost first and second spiral turns of said at least one first heating resistor pass into one another via a substantially S-shaped, central longitudinal portion of said first heating resistor passing continuously between ends outside said longitudinal portion, forming at least one S-bow, at least one spiral turn of at least one said non-first additional heating resistor interengaging between said first and second spiral turns of said first heating resistor.

9. The heater according to claim 8, wherein between legs of the at least one S-bow of said central longitudinal portion of at least one said non-first additional heating resistor, in one of said S-bows an inner end of a second heating resistor and in another of said S-bows an inner end of a third heating resistor are located, said inner ends being electrically conductively interconnected in an area set back with respect to the front of said carrier.

10. The heater according to claim 1, wherein an outermost spiral turn of said at least one first heating resistor is located within at least one spiral turn of a non-first additional said heating resistor, said outermost spiral turn of said first heating resistor being located adjacent to an outermost spiral turn of said heating field.

11. The heater according to claim 1, wherein said two first and second spirals of said at least one first heating resistor have different numbers of spiral turns, an outer spiral of said first heating resistor extending over a larger circumferential angle than an inner spiral substantially formed by a single spiral turn.

12. The heater according to claim 1, wherein an end of an outermost spiral turn of said at least one first heating resistor together with an end of an outermost spiral turn of said heating field is connected to an electric connecting member via a thermal cutout, said outermost spiral turn of said heating field being provided by a non-first additional said heating resistor.

13. The heater according to claim 1, wherein three first and non-first additional heating resistors are provided in a quadruple spiral arrangement.

14. The heater according to claim 1, wherein said first and non-first additional heating resistors are switchable in six power stages in single, series, and parallel connection.

15. The heater according to claim 1, wherein said at least one first heating resistor has a highest rated power compared with all of said at least one non-first additional heating resistors, said first heating resistor being formed by a wire coil having a largest wire cross-section and a greatest wire length extension.

16. The heater according to claim 1, wherein at least one said heating resistor is only fixed at intervals in fixing points to an insulating body provided at the front of said carrier, said at least one heating resistor being otherwise substantially free between said fixing points, said insulating body having limited protuberances shaped therefrom and longitudinally spaced with respect to said heating resistor, said heating resistor being embedded in said protuberances over part of a circumference of said heating resistor.

17. The heater according to claim 1, wherein said at least one first heating resistor is embedded in said carrier substantially over its entire length extension over a part of its circumference in uniform manner.

18. The heater according to claim 16, wherein said protuberances project over a base of a spiral slot and form interruptions of said spiral slot, said interruptions having a same cross-section as said spiral slot.

19. The heater according to claim 1, wherein said heater is a radiant heater.

20. The heater according to claim 1, wherein at least one spiral turn of at least one of said at least two spirals of said at least one first heating resistor engage between two spiral turns of a further one of said at least two spirals of said first heating resistor.

21. The heater according to claim 1, wherein a number of spirally interengaging spirals are provided, said number being greater that said number of the first and non-first additional heating resistors.

22. The heater according to claim 1, wherein all said spiral turns are located substantially parallel.

23. The heater according to claim 1, wherein all spirals provided are alternately juxtaposed in such a way that spiral turns of said spirals follow one another.

24. The heater according to claim 1, wherein between spiral turns of said at least one first heating resistor are located a number of spiral turns, said number being equal to the number of the heating resistors.

25. The heater according to claim 1, wherein all spiral turns of at least one said non-first additional heating resistor are separated by at least one interengaging spiral turn of said at least one first heating resistor.

26. The heater according to claim 1, wherein an outer spiral of said at least two spirals of said at least one first heating resistor has substantially a same number of spiral turns as a non-first additional said heating resistor.

27. The heater according to claim 1, wherein sections of all said first and non-first additional heating resistors are arranged in a center area of the heating field in a substantially uniform distribution.

28. The heater according to claim 1, wherein said at least one first heating resistor has two connecting ends located in the vicinity of a periphery of said heating field.

29. The heater according to claim 1, wherein said at least one non-first additional heating resistor spirally extends substantially from a center area to a periphery of said heating field.

* * * * *